US011137127B2

(12) United States Patent
Tsuchiya et al.

(10) Patent No.: US 11,137,127 B2
(45) Date of Patent: Oct. 5, 2021

(54) LAMP BODY HAVING A LIGHT GUIDE BODY HAVING TWO LIGHT GUIDE LENSES AND A HALF MIRROR FACING A REFLECTOR FOR EMITTING FROM A LIGHT EMITTING SURFACE OF THE LAMP BODY

(71) Applicant: HONDA MOTOR CO., LTD., Tokyo (JP)

(72) Inventors: Yuji Tsuchiya, Wako (JP); Daisuke Nakashima, Wako (JP); Shunsuke Iwao, Wako (JP); Masayoshi Takori, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/110,905

(22) Filed: Dec. 3, 2020

(65) Prior Publication Data

US 2021/0172579 A1 Jun. 10, 2021

(30) Foreign Application Priority Data

Dec. 5, 2019 (JP) ..... JP2019-220452

(51) Int. Cl.

| | |
|---|---|
| ***F21S 43/31*** | (2018.01) |
| ***F21S 43/239*** | (2018.01) |
| ***F21S 43/247*** | (2018.01) |
| ***F21S 43/245*** | (2018.01) |
| ***F21S 43/37*** | (2018.01) |

(52) U.S. Cl.

CPC ..... *F21S 43/315* (2018.01); *F21S 43/239* (2018.01); *F21S 43/245* (2018.01); *F21S 43/247* (2018.01); *F21S 43/37* (2018.01)

(58) Field of Classification Search

CPC ..... F21S 43/235; F21S 43/236; F21S 43/237; F21S 43/239; F21S 43/241; F21S 43/242; F21S 43/243; F21S 43/245; F21S 43/247; F21S 43/249; F21S 43/251; F21S 43/255; F21S 43/30; F21S 43/31; F21S 43/315; F21S 43/33; F21S 43/37

See application file for complete search history.

(56) References Cited

U.S. PATENT DOCUMENTS 5,634,708 A * 6/1997 Koie ..... B60Q 1/302 362/503
9,677,735 B2 * 6/2017 Hardy ..... F21S 43/241

FOREIGN PATENT DOCUMENTS

JP 2017-092010 A 5/2017

* cited by examiner

*Primary Examiner* — Robert J May
(74) *Attorney, Agent, or Firm* — Squire Patton Boggs (US) LLP

(57) ABSTRACT

A lamp body includes a light source, a light guide body configured to cause light from the light source to be guided and cause the light to be emitted from a light emitting surface, a reflector configured to cause the light, which has exited from a light guide exit surface of the light guide body, to be reflected toward a side of the light emitting surface; and a half mirror disposed to face the reflector and having a reflection area where the light reflected by the reflector is reflected toward a side of the reflector and a transmission area where the reflected light is transmitted. In the light guide body, a first light guide lens causes the light to be guided in a first direction and a second light guide lens has the light guide exit surface from which the light exits in a second direction intersecting the first direction.

9 Claims, 9 Drawing Sheets

LAMP BODY HAVING A LIGHT GUIDE BODY HAVING TWO LIGHT GUIDE LENSES AND A HALF MIRROR FACING A REFLECTOR FOR EMITTING FROM A LIGHT EMITTING SURFACE OF THE LAMP BODY

CROSS-REFERENCE TO RELATED APPLICATION

Priority is claimed on Japanese Patent Application No. 2019-220452, filed Dec. 5, 2019, the content of which is incorporated herein by reference.

BACKGROUND OF THE INVENTION

Field of the Invention

The present invention relates to a lamp body.

Description of Related Art

Conventionally, a configuration in which a light source and a light guide body are combined in a lamp body for a vehicle such as a tail lamp is known. Various technologies for causing light from a light emitting surface to be three-dimensionally viewed by internally reflecting light from a light source a plurality of times so that a sense of depth can be expressed with size reduction in lamp bodies have been proposed.

For example, in Patent Document 1 (Japanese Unexamined Patent Application, First Publication No. 2017-92010), a configuration of a light guide body including a light guide exit surface configured to cause one part of light to exit from a light source in one direction; a light guide incidence surface on which the light, which has exited from the light guide exit surface, is incident; and light guide reflection surfaces configured to reflect the other part of the light from the light source or the light incident from the light guide incidence surface toward a light emitting surface side is disclosed. The light guide reflection surfaces are disposed side by side at different heights in the one direction.

According to the technology described in Patent Document 1, light emission of the light emitting surface can be three-dimensionally visually recognized due to the light reflected by the light guide reflection surfaces having different heights and directed toward the light emitting surface side while avoiding an increase in size.

SUMMARY OF THE INVENTION

However, in the technology described in Patent Document 1, there is room for improvement in suitably expressing a sense of depth.

An objective of the present invention is to provide a lamp body capable of suitably expressing a sense of depth while restricting an increase in size.

A lamp body of the present invention has the following configurations.

(1) According to an aspect of the present invention, a lamp body (for example, a lamp body 1 in a first embodiment) is provided including: a light source (for example, a light source 5 in the first embodiment); a light guide body (for example, a light guide body 6 in the first embodiment) configured to cause light (for example, light L in the first embodiment) from the light source to be guided and cause the light to be emitted from a light emitting surface (for example, a light emitting surface 45 in the first embodiment); a reflector (for example, a reflector 7 in the first embodiment) configured to cause the light, which has exited from a light guide exit surface (for example, a light guide exit surface 65*b* or 66*b* in the first embodiment) of the light guide body, to be reflected toward a side of the light emitting surface; and a half mirror (for example, a half mirror 4 in the first embodiment) disposed to face the reflector and having a reflection area (for example, a reflection area A1 in the first embodiment) where the light reflected by the reflector is reflected toward a side of the reflector and a transmission area (for example, a transmission area A2 in the first embodiment) where the reflected light is transmitted, wherein the light guide body includes a first light guide lens (for example, a first light guide lens 61 in the first embodiment) configured to cause the light from the light source to be guided in a first direction; and a second light guide lens (for example, a second light guide lens 62 in the first embodiment) having the light guide exit surface from which the light exits in a second direction intersecting the first direction and wherein the first light guide lens and the second light guide lens are disposed in contact with each other.

(2) In the lamp body according to the aspect (1), at least a part of the light guide body may be provided between the reflector and the half mirror.

(3) In the lamp body according to the aspect (1) or (2), the light guide body may include a pattern forming portion (for example, a pattern forming portion 269 in a second embodiment) having a fine cut.

(4) In the lamp body according to the aspect (3), the pattern forming portion may be provided on the second light guide lens and the second light guide lens may be inserted between the reflector and the half mirror.

(5) In the lamp body according to any one of the aspects (1) to (4), a distance between the reflector and the half mirror may gradually change in the second direction.

(6) In the lamp body according to the aspect (5), the reflector may have a convex curved surface (for example, a convex curved surface 71 in the first embodiment) that is convex toward a side of the half mirror.

(7) In the lamp body according to any one of the aspects (1) to (6), the half mirror may be formed by disposing the reflection area formed by plating (for example, plating 41 in the first embodiment) deposited on a transparent plate (for example, a transparent plate 40 in the first embodiment) and the transmission area from which the plating has been removed in a grid pattern.

According to the aspect of (1), the lamp body includes the reflector and the half mirror facing each other and the light guide body configured to cause light to be incident between the reflector and the half mirror. Thereby, the light from the light source can be reflected a plurality of times between the reflector and the half mirror and the light emitted from the light emitting surface can give a sense of depth. A size of the lamp body in an incident direction of the light incident on the light emitting surface can be reduced.

The light guide body includes the first light guide lens and the second light guide lens disposed in contact with each other. The light guide body causes the light from the light source to be guided and causes light to be emitted from the light emitting surface. Thereby, for example, the first light guide lens causes the light from the light source to diverge and converge, causes the light to be emitted from the light emitting surface, and displays a grid pattern. On the other hand, since the second light guide lens is in contact with the first light guide lens, the light transmitted through the first light guide lens is allowed to diverge and converge and is emitted from the light emitting surface. By providing the second light guide lens, the grid pattern can be displayed more clearly and the sense of depth can be emphasized. As described above, the lamp body clearly displays the grid pattern with the first light guide lens and the second light guide lens. Thereby, the depth expression given by reflecting light between the reflector and the half mirror can be more emphasized and displayed on the light emitting surface.

Therefore, it is possible to provide a lamp body that can suitably express a sense of depth while restricting an increase in size.

According to the aspect of (2), at least the part of the light guide body is provided between the reflector and the half mirror. Thereby, the light from the light source can be allowed to exit from the light guide exit surface of the light guide body to a space between the reflector and the half mirror. Consequently, light can be effectively reflected between the reflector and the half mirror to express a sense of depth.

According to the aspect of (3), the light guide body includes the pattern forming portion having the fine cut. Thereby, when light is transmitted through the light guide body, a pattern giving a sense of floating can be displayed on the light emitting surface according to a shape of the fine cut. By combining the sense of floating of the pattern formed by the pattern forming portion and the sense of depth by reflecting light between the reflector and the half mirror, it is possible to provide a lamp body that further emphasizes the sense of depth.

According to the aspect of (4), the pattern forming portion is provided on the second light guide lens and the second light guide lens is inserted between the reflector and the half mirror. Thereby, it is possible to effectively combine the sense of floating of the pattern formed by the pattern forming portion and the depth expression given by reflecting light between the reflector and the half mirror. Since a pattern giving a sense of floating can be displayed within a space in which the depth is expressed, the sense of floating of the pattern on the light emitting surface can be emphasized. Consequently, the sense of depth and the sense of floating can be effectively expressed.

According to the aspect of (5), since the distance between the reflector and the half mirror gradually changes in the second direction, it is possible to express a sense of depth that has been curved in accordance with the distance. As compared with when the distance changes stepwise, continuous depth expression in the depth direction is possible. Consequently, it is possible to provide a lamp body having the excellent design and having the improved appearance quality and the improved degree of freedom of expression at the time of light emission.

According to the aspect of (6), the reflector has a convex curved surface that is convex toward the side of the half mirror. As described above, by providing the convex curved surface on the reflector side and causing a reflection surface of the reflector to be curved, the distance between the reflector and the half mirror can be gradually changed. Consequently, it is possible to express a sense of depth curved in the depth direction with a simple configuration.

According to the aspect of (7), the half mirror is formed by disposing the reflection area formed by the plating deposited on the transparent plate and the transmission area from which the plating has been removed in the grid pattern. As described above, the half mirror can be formed in a pseudo manner by applying the plating to a part of the transparent plate. For example, by changing a ratio between the reflection area and the transmission area, a half mirror having desired transmittance can be easily formed. Consequently, it is possible to provide the half mirror that is easily manufactured and has a high degree of design freedom.

DETAILED DESCRIPTION OF THE INVENTION

Hereinafter, embodiments of the present invention will be described with reference to the drawings.

First Embodiment (Lamp Body)

Figure 1:
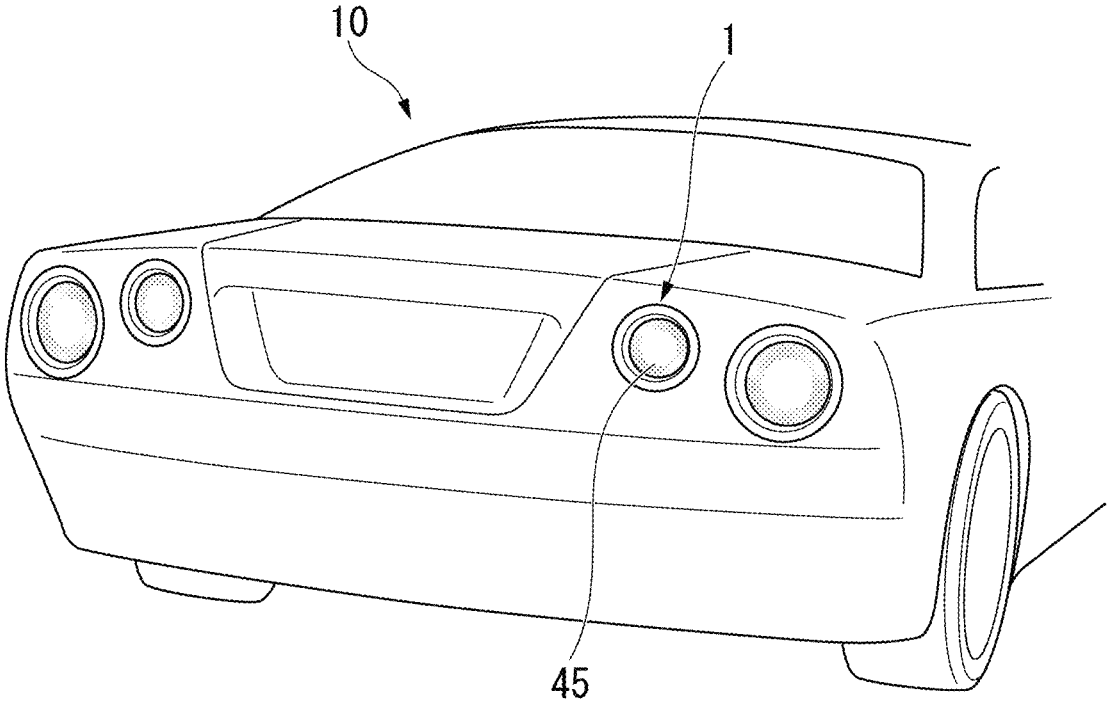
FIG. 1 is a perspective view of a vehicle equipped with a lamp body according to the first embodiment viewed from the rear.

FIG. 1 is a perspective view of a vehicle 10 equipped with a lamp body 1 according to a first embodiment viewed from the rear. For example, the lamp body 1 is applied to a tail lamp or a brake lamp provided at a rear end of the vehicle 10. The lamp body 1 emits light rearward from the vehicle 10.

Figure 2:
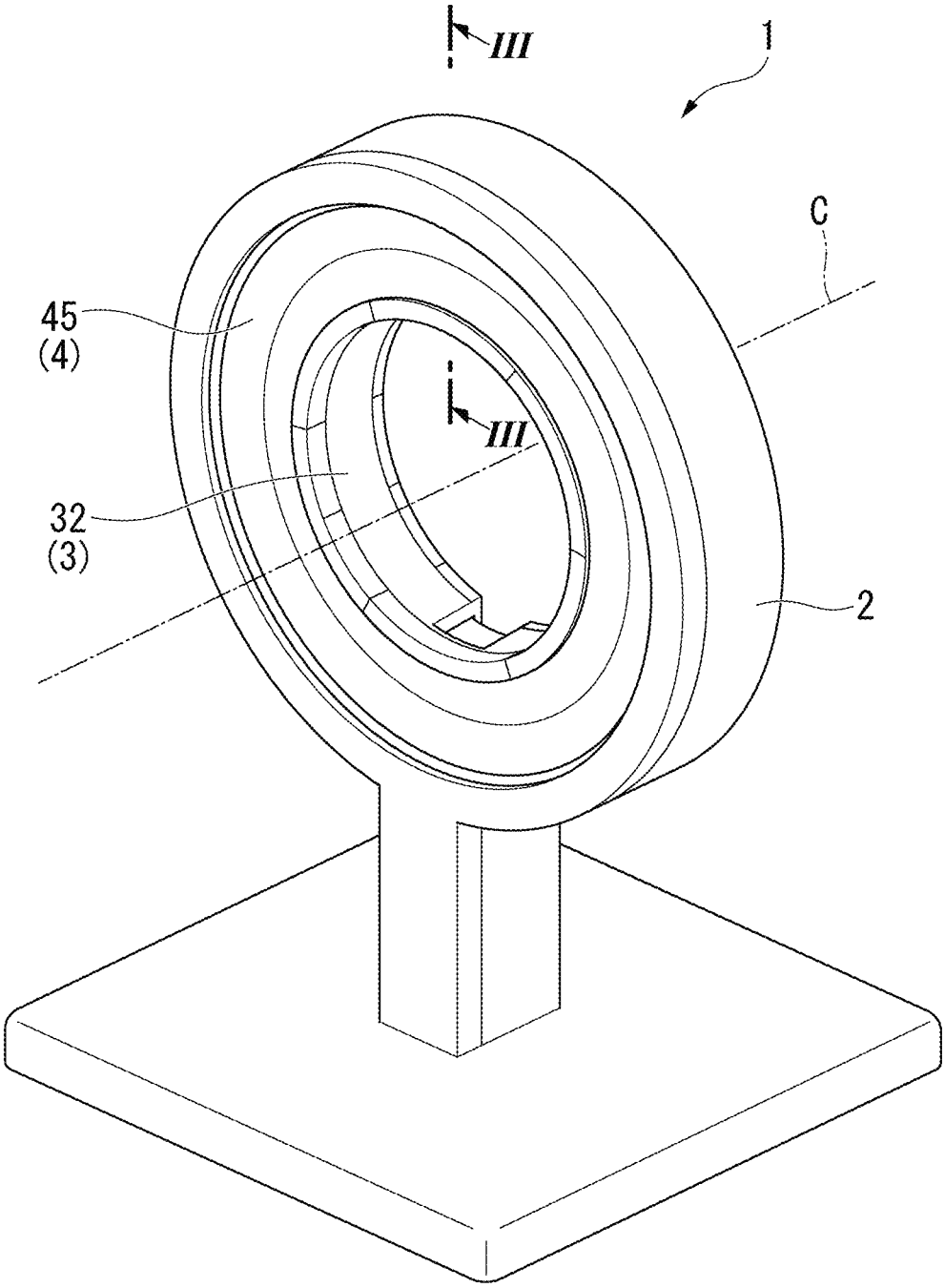
FIG. 2 is an exterior perspective view of the lamp body according to the first embodiment.
Figure 3:
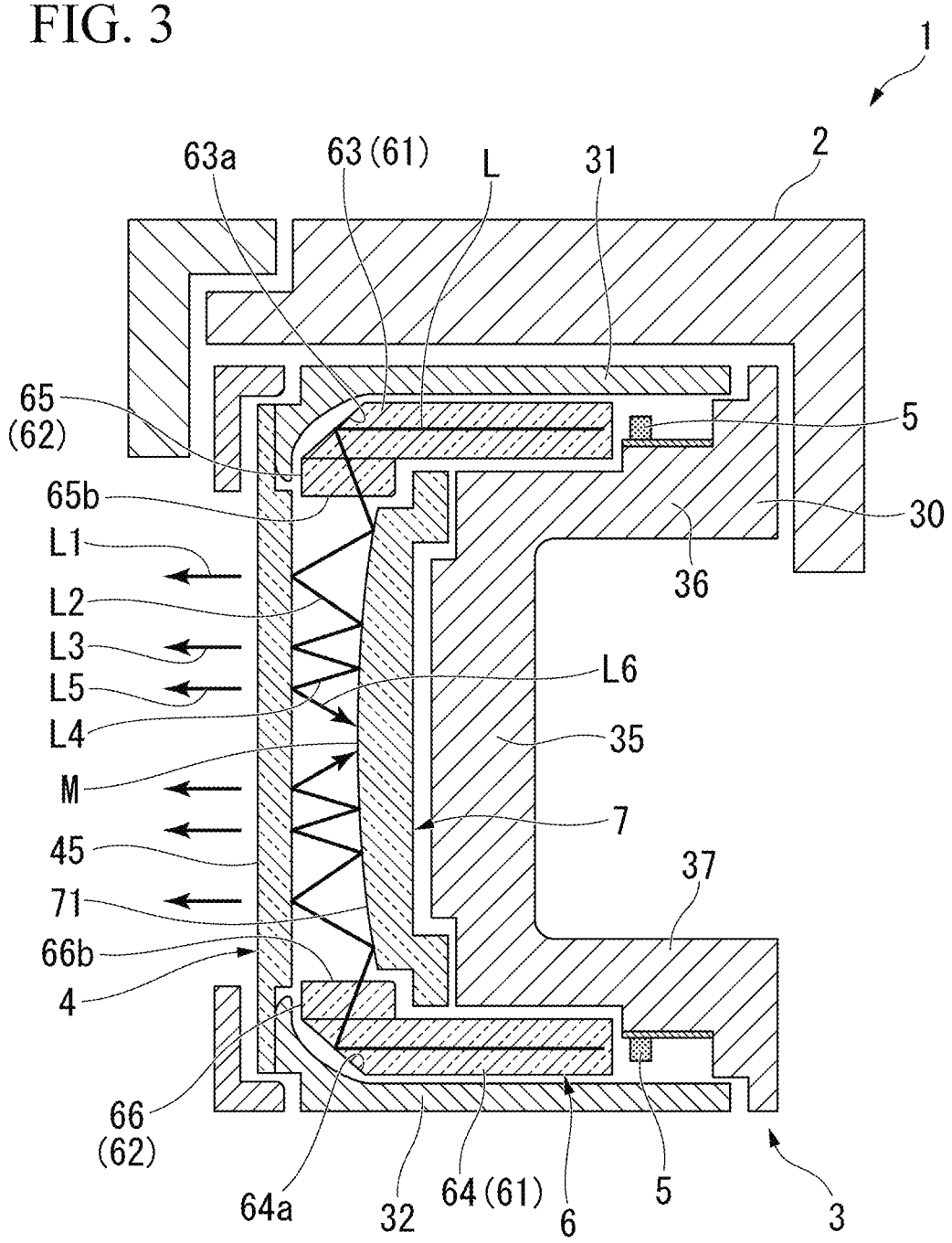
FIG. 3 is a cross-sectional view of the lamp body taken along the line of FIG. 2.

FIG. 2 is an exterior perspective view of the lamp body 1 according to the first embodiment. FIG. 3 is a cross-sectional view of the lamp body 1 taken along the line III-III of FIG. 2.

As shown in FIG. 2, the lamp body 1 is formed in an annular shape centered on an axis C in a front-rear direction of the vehicle 10. In the following description, a direction along the axis C of the lamp body 1 may be simply referred to as an axial direction, a direction orthogonal to the axis C may be referred to as a radial direction, and a direction around the axis C may be referred to as a circumferential direction. An irradiation direction of light in the axial direction is referred to as a rearward direction in the axial direction and a direction opposite to the rearward direction may be referred to as a forward direction in the axial direction.

As shown in FIG. 3, the lamp body 1 includes a case 2, a base 3, a half mirror 4, light sources 5, a light guide body 6, and a reflector 7.

As shown in FIGS. 2 and 3, the case 2 is formed in an annular shape centered on the axis C. The case 2 forms an outer circumferential portion of the lamp body 1.

The base 3 is disposed inside the case 2 in the radial direction. The base 3 has a main base 30, an outer sub-base 31, and an inner sub-base 32.

The main base 30 is formed in an annular shape centered on the axis C. The main base 30 is formed in a U shape that is convex rearward in the axial direction in a cross-sectional view (the cross-sectional view of FIG. 3) viewed from the radial direction. Specifically, the main base 30 has a bottom wall 35, an outer side wall 36, and an inner side wall 37. The bottom wall 35 faces in the axial direction and is formed in an annular shape. The outer side wall 36 is connected to the outer circumferential portion of the bottom wall 35 and extends forward in the axial direction. The inner side wall 37 is connected to the inner circumferential portion of the bottom wall 35 and extends forward in the direction. The main base 30 formed in this manner forms a front portion of the lamp body 1 in the axial direction.

The outer sub-base 31 is disposed between the outer side wall 36 of the main base 30 and the case 2 in the radial direction. The outer sub-base 31 extends in the axial direction. The outer sub-base 31 is formed in an annular shape centered on the axis C.

The inner sub-base 32 is formed in an annular shape having a smaller outer diameter than the outer sub-base 31. The inner sub-base 32 is disposed inward from the inner side wall 37 of the main base 30 in the radial direction. The inner sub-base 32 extends in the axial direction. The inner sub-base 32 is provided coaxially with the axis C. The inner sub-base 32 forms an inner circumferential portion of the lamp body 1.

The lamp body 1 is formed in a ring frame shape that opens rearward by the case 2, the main base 30, and the inner sub-base 32. Part of the case 2 forming the outer circumferential portion of the lamp body 1 extends in the radial direction and is connected to a vehicle body. Thereby, the lamp body 1 is attached to the vehicle body.

The half mirror 4 closes an opening formed by the case 2, the main base 30, and the inner sub-base 32. The half mirror 4 is formed in an annular shape centered on the axis C. The half mirror 4 forms a rear portion of the lamp body 1 in the axial direction. A surface of the half mirror 4 facing rearward in the axial direction serves as a light emitting surface 45.

Figure 4:
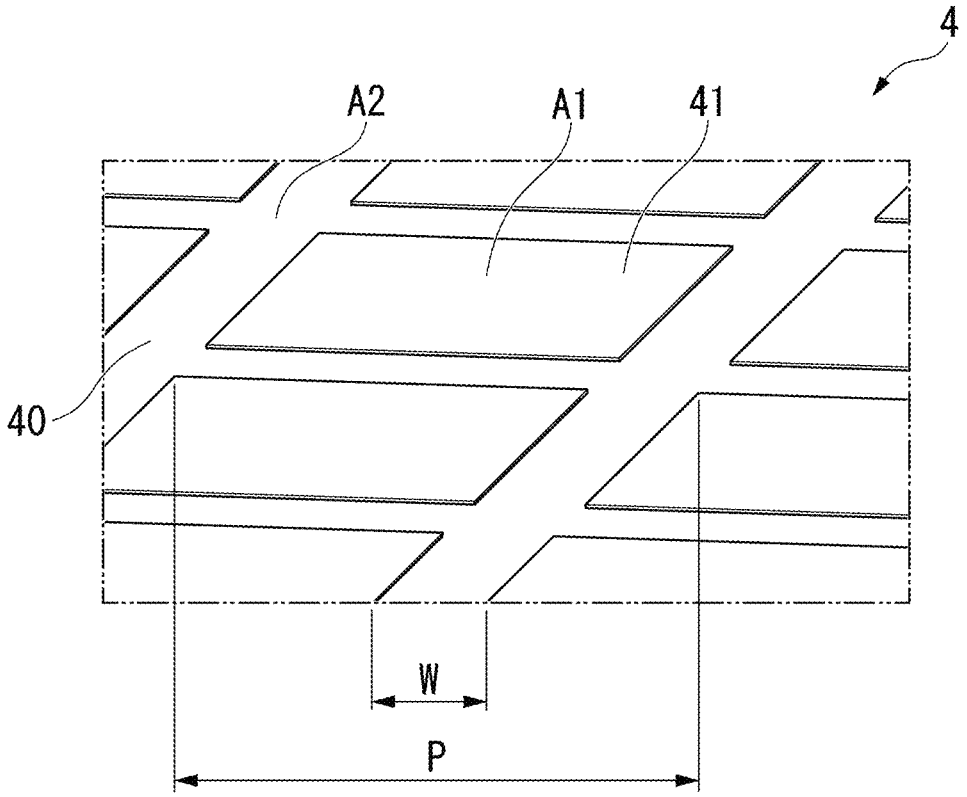
FIG. 4 is an explanatory diagram showing a configuration of a half mirror according to the first embodiment.

FIG. 4 is an explanatory diagram showing a configuration of the half mirror 4 according to the first embodiment. FIG. 4 is an enlarged view showing part of the surface of the half mirror 4.

The half mirror 4 has plating 41 formed by depositing a metal material such as aluminum at a predetermined location on a transparent plate 40 such as a glass plate. The half mirror 4 has a reflection area A1 formed by the plating 41 deposited on the transparent plate 40 and a transmission area A2 from which the plating 41 has been removed. The transmission area A2 is formed in a grid pattern. The reflection area A1 is provided between transmission areas A2. The reflection area A1 is formed in a rectangular shape. The half mirror 4 is set to have desired transmittance by setting a pitch P between adjacent reflection areas A1 and a width W of the transmission area A2 to predetermined values.

As shown in FIG. 3, the half mirror 4 is disposed to face the reflector 7, which will be described below in detail. The half mirror 4 reflects part of light L reflected by the reflector 7 and causes the remaining part of the reflected light L to be transmitted toward the light emitting surface 45 side. That is, the half mirror 4 causes the light L incident on the reflection area A1 within the light L reflected by the reflector 7 to be reflected toward the reflector 7 side again. The half mirror 4 causes the light L incident on the transmission area A2 within the light L reflected by the reflector 7 to be transmitted and causes the light L to be emitted from the light emitting surface 45.

The light source 5, the light guide body 6, and the reflector 7 are disposed in a space surrounded by the half mirror 4, the case 2, the main base 30, and the inner sub-base 32 formed as described above.

The light sources 5 are disposed within spaces provided between the outer side wall 36 of the main base 30 and the outer sub-base 31 and between the inner side wall 37 of the main base 30 and the inner sub-base 32. The light sources 5 are attached to the outer side wall 36 and the inner side wall 37 of the main base 30 respectively. The light source 5 emits light L rearward in the axial direction. A plurality of light sources 5 are provided at intervals in the circumferential direction. The light source 5 attached to the outer side wall 36 and the light source 5 attached to the inner side wall 37 are provided at positions corresponding to each other in the circumferential direction.

The light guide body 6 causes the light L from the light source 5 to be guided and causes the light L to be emitted from the light emitting surface 45 located rearward from the light source 5 in the axial direction. The light guide body 6 includes a first light guide lens 61 and a second light guide lens 62.

The first light guide lens 61 is provided rearward from the light source 5 in the axial direction and provided at a position equivalent to that of the light source 5 in the radial direction. The first light guide lens 61 includes an outer first light guide lens 63 and an inner first light guide lens 64.

The outer first light guide lens 63 is formed in a cylindrical shape centered on the axis C. The outer first light guide lens 63 is disposed between the outer side wall 36 of the main base 30 and the outer sub-base 31. The outer first light guide lens 63 extends in the axial direction. The outer first light guide lens 63 causes the light L from the light source 5 attached to the outer side wall 36 of the main base 30 to be guided rearward.

The inner first light guide lens 64 is formed in a cylindrical shape centered on the axis C. The inner first light guide lens 64 is disposed between the inner side wall 37 of the main base 30 and the inner sub-base 32. The inner first light guide lens 64 extends in the axial direction. The inner first light guide lens 64 causes the light L from the light source 5 attached to the inner side wall 37 of the main base 30 to be guided rearward.

Within the outer first light guide lens 63 and the inner first light guide lens 64, the light guide reflection surfaces 63*a* and 64*a* are formed at ends opposite to the light sources 5. The light guide reflection surfaces 63*a* and 64*a* are inclined by about 45° with respect to the axial direction.

Figure 5:
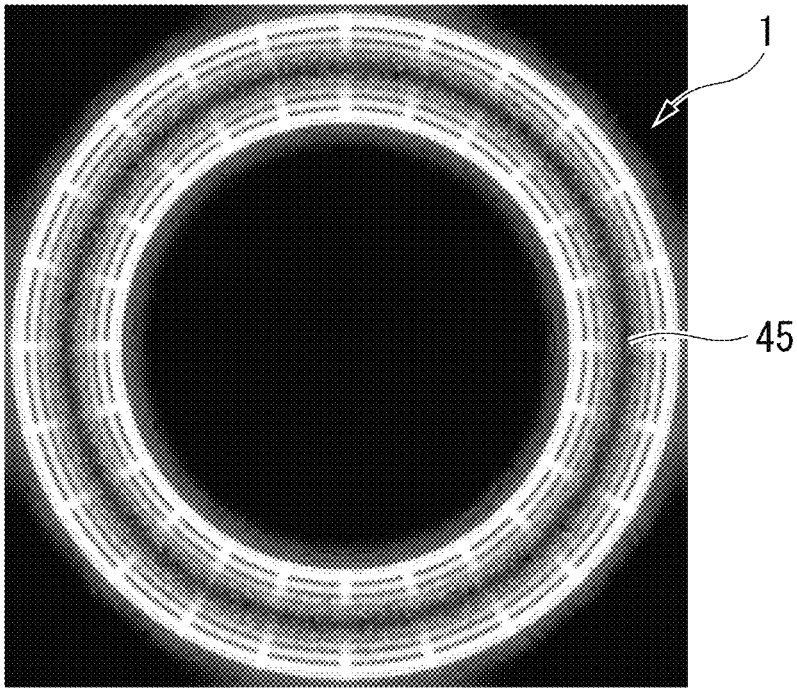
FIG. 5 is a front view showing a state of light emission of the lamp body according to the first embodiment.

The first light guide lens 61 formed as described above causes the light L from the light source 5 to diverge and converge and therefore causes grid-shaped light in the radial direction to be displayed on the light emitting surface 45 (also see FIG. 5).

The second light guide lens 62 is provided at a rear end portion of the first light guide lens 61 in the axial direction. A length of the second light guide lens 62 in the axial direction is shorter than a length of the first light guide lens 61 in the axial direction. The second light guide lens 62 includes an outer second light guide lens 65 and an inner second light guide lens 66.

The outer second light guide lens 65 is provided inward from the outer first light guide lens 63 in the radial direction. The outer second light guide lens 65 is disposed in contact with the outer first light guide lens 63. Light L from the light source 5 transmitted through the outer first light guide lens 63 is incident on the outer second light guide lens 65. The outer second light guide lens 65 has a light guide exit surface 65*b*. The light guide exit surface 65*b* is provided on a surface of the outer second light guide lens 65 that faces inward in the radial direction. The light guide exit surface 65*b* causes the light L incident from the outer first light guide lens 63 to the outer second light guide lens 65 to exit inward in the radial direction and toward the reflector 7 side.

The inner second light guide lens 66 is provided outward from the inner first light guide lens 64 in the radial direction. The inner second light guide lens 66 is disposed in contact with the inner first light guide lens 64. The light L from the light source 5 transmitted through the inner first light guide lens 64 is incident on the inner second light guide lens 66. The inner second light guide lens 66 has a light guide exit surface 66*b*. The light guide exit surface 66*b* is provided on a surface of the inner second light guide lens 66 that faces outward in the radial direction. The light guide exit surface 66*b* causes the light L incident from the inner first light guide lens 64 to the inner second light guide lens 66 to exit outward in the radial direction and toward the reflector 7 side.

The outer second light guide lens 65 and the inner second light guide lens 66 are disposed apart from each other in the radial direction.

The reflector 7 is provided between the half mirror 4 and the main base 30 in the axial direction. The reflector 7 is attached to the bottom wall 35 of the main base 30. The reflector 7 is formed in an annular shape centered on the axis C. The reflector 7 is disposed to face the half mirror 4. The reflector 7 is provided at intervals with respect to the half mirror 4. The second light guide lens 62 is disposed between the reflector 7 and the half mirror 4. The reflector 7 is provided across the inner first light guide lens 64 and the outer first light guide lens 63 in the radial direction.

A surface of the reflector 7 facing rearward in the axial direction serves as a convex curved surface 71. The convex curved surface 71 is formed to be convex toward the half mirror 4 side. The convex curved surface 71 is curved to protrude furthest rearward in the axial direction at an intermediate portion M between the inner first light guide lens 64 and the outer first light guide lens 63 in the radial direction. Thereby, a distance between the reflector 7 and the half mirror 4 gradually changes in the radial direction. The convex curved surface 71 of the reflector 7 causes the light L, which has exited from the light guide exit surfaces 65*b* and 66*b* of the light guide body 6, to be totally reflected toward the light emitting surface 45 side.

(Optical Path)

Figure 6:
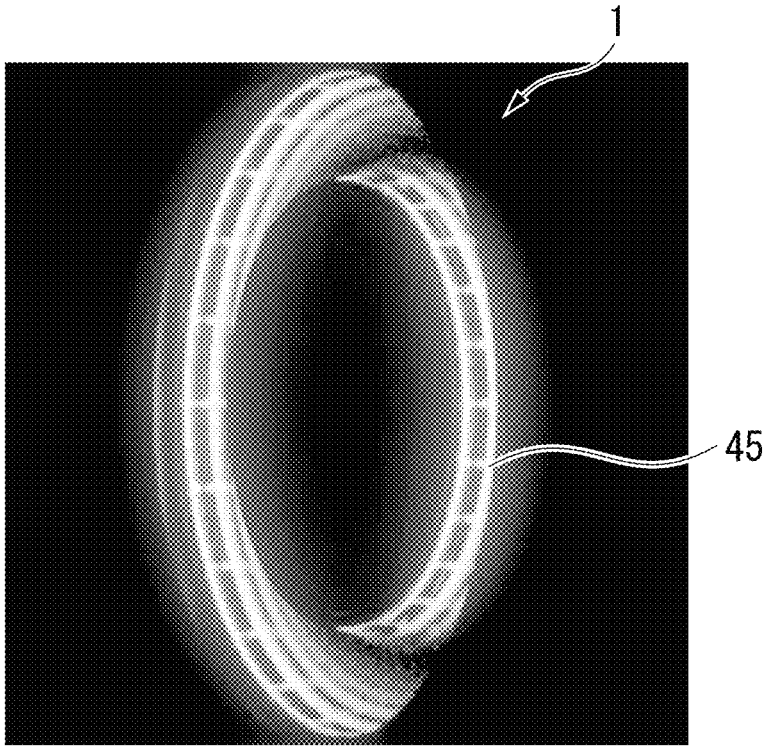
FIG. 6 is a perspective view showing a state of light emission of the lamp body according to the first embodiment.

Next, an optical path until the light L emitted from the light source 5 reaches the light emitting surface 45 in the above-described lamp body 1 will be described with reference to FIGS. 3, 5, and 6.

As shown in FIG. 3, first, the light L exits from the light source 5 rearward in the axial direction (a first direction of the claims). The light L, which has exited from the light source 5, is guided in the axial direction and the circumferential direction by the first light guide lens 61. The light L, which has been guided in the axial direction or the circumferential direction is reflected by the light guide reflection surfaces 63*a* and 64*a* of the first light guide lens 61. At this time, the light guide reflection surfaces 63*a* and 64*a* change a traveling direction of the light L guided in the axial direction from the light source 5 to a direction intersecting the axial direction (a second direction of the claims). The direction intersecting the axial direction is a direction in which the light L is obliquely incident on the reflector 7 rearward in an angular range between a direction toward the bottom wall 35 side of the main base 30 in the radial direction and a direction forward in the axial direction.

The light L, which has exited from the first light guide lens 61, is incident on the second light guide lens 62 disposed in contact with the first light guide lens 61. Subsequently, the light L exits obliquely forward from the light guide exit surfaces 65*b* and 66*b* of the second light guide lens 62 and reaches the reflector 7.

Next, the light L is totally reflected toward the half mirror 4 side by the reflector 7. Part (light L1) of the light L, which has been totally reflected by the reflector 7 and has reached the half mirror 4, is transmitted through the transmission area A2 of the half mirror 4, reaches the light emitting surface 45, and is emitted from the light emitting surface 45. The remaining part (light L2) of the light L, which has been totally reflected by the reflector 7 and has reached the half mirror 4, is reflected by the reflection area A1 of the half mirror 4 and is totally reflected by the reflector 7 again.

Next, after part (light L3) of the light L2 totally reflected by the reflector 7 for the second time reaches the half mirror 4, the light L3 is transmitted through the transmission area A2 of the half mirror 4, reaches the light emitting surface 45, and is emitted from the light emitting surface 45. On the other hand, the remaining part (light L4) of the light L2, which has been totally reflected by the reflector 7 for the second time and has reached the half mirror 4, is reflected by the reflection area A1 of the half mirror 4 and is totally reflected by the reflector 7 again.

Here, the light L3, which is totally reflected by the reflector 7 for the second time and reaches the light emitting surface 45, is emitted from the light emitting surface 45 on the intermediate portion M side in the radial direction on the convex curved surface 71 as compared with the light L1, which is totally reflected for the first time and reaches the light emitting surface 45. The brightness of the light L3 is lower than the brightness of the light L1.

Next, after part (light L5) of the light L4, which has been totally reflected by the reflector 7 for the third time reaches the half mirror 4, the light L5 is transmitted through the transmission area A2 of the half mirror 4, reaches the light emitting surface 45, and is emitted from the light emitting surface 45. On the other hand, the remaining part (light L6) of the light L4, which has been totally reflected by the reflector 7 for the third time and has reached the half mirror 4, is reflected by the reflection area A1 of the half mirror 4 and is totally reflected by the reflector 7 again.

Here, the light L5, which is totally reflected by the reflector 7 for the third time and reaches the light emitting surface 45, is emitted from the light emitting surface 45 on the intermediate portion M side in the radial direction on the convex curved surface 71 as compared with the light L3, which is totally reflected for the second time and reaches the light emitting surface 45. The brightness of the light L5 is lower than the brightness of the light L3.

FIG. 5 is a front view showing a state of light emission of the lamp body 1 according to the first embodiment. FIG. 6 is a perspective view of the state of light emission of the lamp body 1 according to the first embodiment viewed obliquely from the rear.

As described above, the light L, which has exited from the light source 5, is further iteratively reflected between the reflector 7 and the half mirror 4 a plurality of times such as the fourth time, the fifth time, and the like. Thereby, a plurality of optical paths can be generated and three-dimensional light giving a sense of depth can be visually recognized. Specifically, as shown in FIGS. 5 and 6, the entire light is emitted in a convex shape rearward so that the brightness gradually decreases from the outer circumferential portion and the inner circumferential portion of the lamp body 1 to the intermediate portion M in the radial direction in the convex curved surface 71 in consideration of a distance between the convex curved surface 71 of the reflector 7 and the half mirror 4.

As shown in FIG. 5, the light L, which has been converged by the first light guide lens 61 and the second light guide lens 62 formed in a cylindrical shape, has higher brightness than that of other locations. Thereby, a radial pattern in the radial direction is displayed on the light emitting surface 45. Consequently, a grid-shaped pattern is formed by the light L combined with the light which has been reflected a plurality of times between the reflector 7 and the half mirror 4 and the light L which has been converged by the first light guide lens 61 and the second light guide lens 62. By forming the grid-shaped pattern, the sense of depth is emphasized and more three-dimensional light emission can be visually recognized.

(Action and Effect)

Next, the action and effect of the above-described lamp body 1 will be described.

According to the lamp body 1 of the present embodiment, the lamp body 1 includes the reflector 7 and the half mirror 4 facing each other and the light guide body 6 for causing light L to be incident between the reflector 7 and the half mirror 4. Thereby, the light L from the light source 5 can be reflected a plurality of times between the reflector 7 and the half mirror 4 and the light L emitted from the light emitting surface 45 can give a sense of depth. The size of the lamp body 1 in the incident direction (the axial direction) of the light L incident on the light emitting surface 45 can be reduced.

The light guide body 6 includes the first light guide lens 61 and the second light guide lens 62 disposed in contact with each other. The light guide body 6 causes the light L from the light source 5 to be guided and causes the light L to be emitted from the light emitting surface 45. Thereby, for example, the first light guide lens 61 causes the light L from the light source 5 to diverge and converge, causes the light L to be emitted from the light emitting surface 45, and displays a grid pattern. On the other hand, since the second light guide lens 62 is in contact with the first light guide lens 61, the light L transmitted through the first light guide lens 61 is allowed to diverge and converge and is emitted from the light emitting surface 45. By providing the second light guide lens 62, the grid pattern can be displayed more clearly and the sense of depth can be emphasized. As described above, the lamp body 1 clearly displays the grid pattern on the first light guide lens 61 and the second light guide lens 62. Thereby, the depth expression given by reflecting the light L between the reflector 7 and the half mirror 4 can be further emphasized and displayed on the light emitting surface 45.

Therefore, it is possible to provide the lamp body 1 capable of expressing a sense of depth while restricting an increase in size.

At least part (the second light guide lens 62 in the present embodiment) of the light guide body 6 is provided between the reflector 7 and the half mirror 4. Thereby, the light L from the light source 5 can be allowed to exit from the light guide exit surfaces 65*b* and 66*b* of the light guide body 6 to a space between the reflector 7 and the half mirror 4. Consequently, the light L can be effectively reflected between the reflector 7 and the half mirror 4 to express a sense of depth.

The reflector 7 has the convex curved surface 71. Thereby, a distance between the reflector 7 and the half mirror 4 gradually changes in the radial direction, so that a sense of depth that has been curved can be expressed in accordance with the distance. As compared with when the distance changes stepwise, continuous (smooth) depth expression in the depth direction is possible. Consequently, it is possible to provide the lamp body 1 having the excellent design and having the improved appearance quality and the improved degree of freedom of expression at the time of light emission.

The reflector 7 has the convex curved surface 71 that is convex toward the half mirror 4 side. As described above, by providing the convex curved surface 71 on the reflector 7 side and causing a reflection surface of the reflector 7 to be curved, the distance between the reflector 7 and the half mirror 4 can be gradually changed. Consequently, it is possible to express a sense of depth curved in the depth direction with a simple configuration.

The half mirror 4 is formed by disposing the reflection area A1 formed by the plating 41 deposited on the transparent plate 40 and the transmission area A2 from which the plating 41 has been removed in the grid pattern. As described above, the half mirror 4 can be formed in a pseudo manner by applying the plating 41 to part of the transparent plate 40. For example, by changing a ratio between the reflection area A1 and the transmission area A2, the half mirror 4 having desired transmittance can be easily formed. Consequently, it is possible to provide the half mirror 4 that is easily manufactured and has a high degree of design freedom.

Second Embodiment

Next, a second embodiment according to the present invention will be described.

Figure 7:
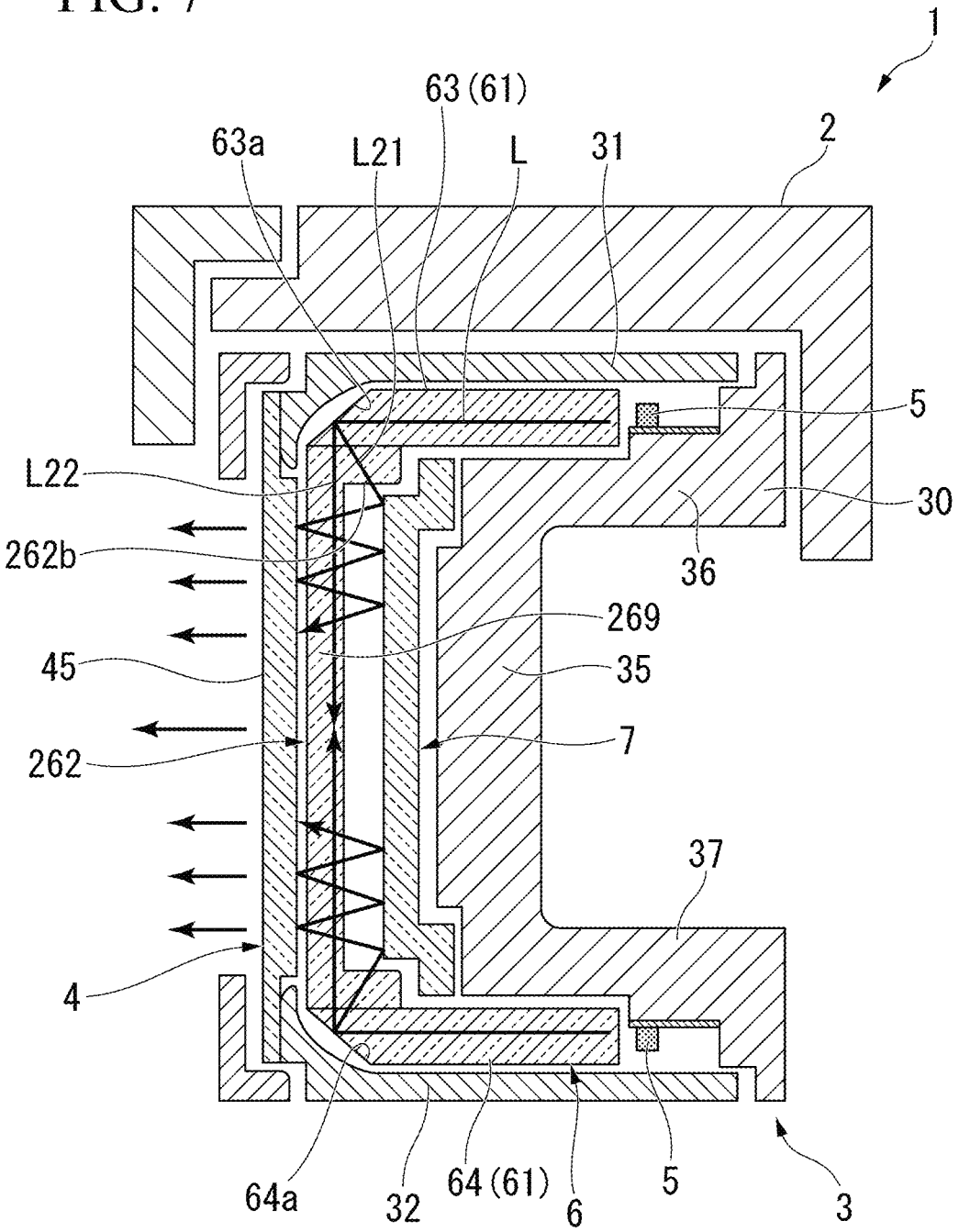
FIG. 7 is a cross-sectional view of a lamp body according to a second embodiment.
Figure 8:
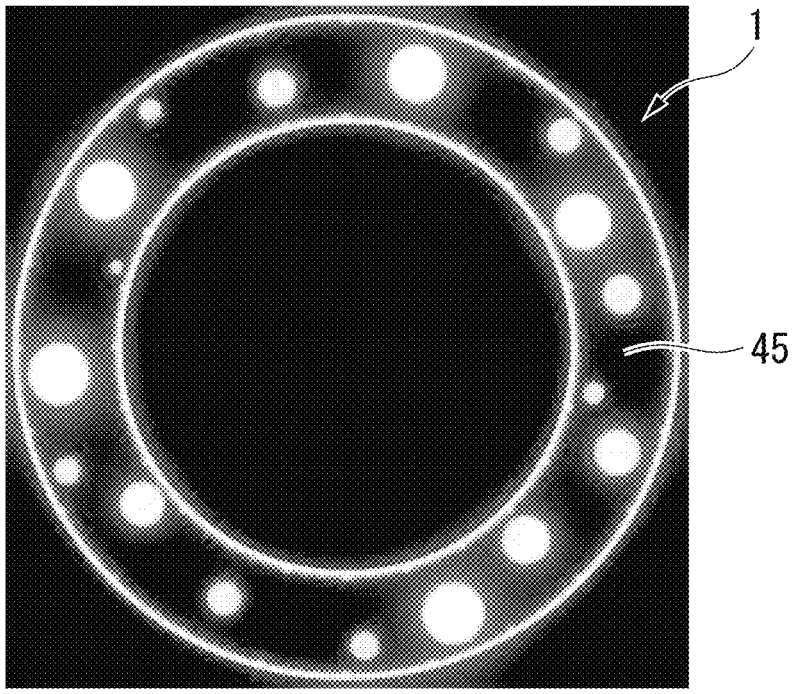
FIG. 8 is a front view showing a state of light emission of the lamp body according to the second embodiment.
Figure 9:
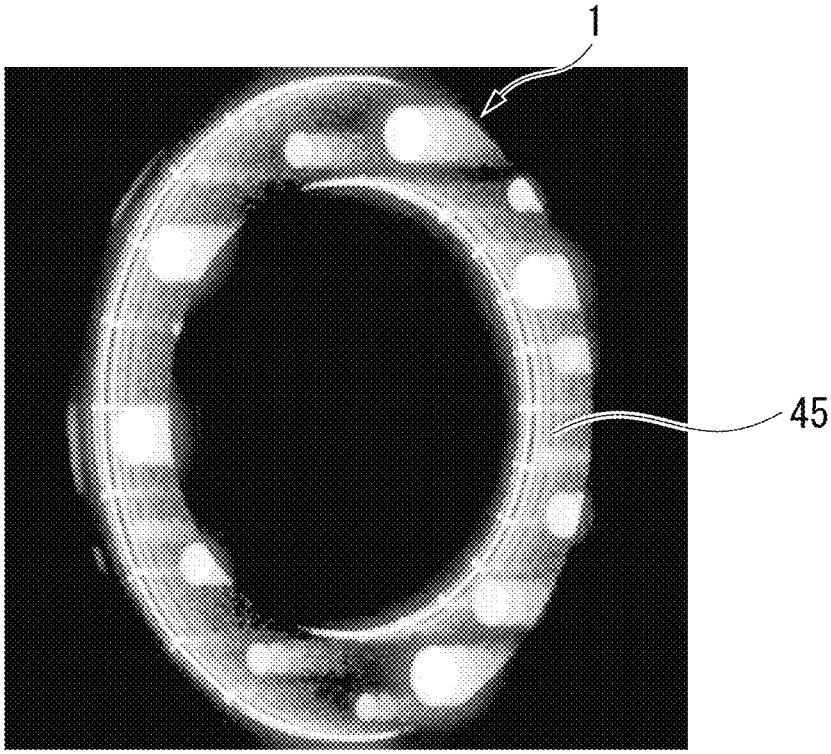
FIG. 9 is a perspective view showing a state of light emission of the lamp body according to the second embodiment.

FIG. 7 is a cross-sectional view of the lamp body 1 according to the second embodiment. FIG. 8 is a front view showing a state of light emission of the lamp body 1 according to the second embodiment. FIG. 9 is a perspective view of a state of light emission of the lamp body 1 according to the second embodiment viewed obliquely from the rear. In the following description, components similar to those in the first embodiment described above are denoted by the same reference signs and description thereof will be appropriately omitted. Reference signs which are not shown in FIGS. 7 to 9 can be appropriately referred to from FIGS. 1 to 6.

The second embodiment is different from the first embodiment in that a second light guide lens 62 includes a pattern forming portion 269.

In the second embodiment, a second light guide lens 262 is provided between an outer first light guide lens 63 and an inner first light guide lens 64 in a radial direction. A width of the second light guide lens 262 in the radial direction is formed so that the width is equivalent to a distance between the outer first light guide lens 63 and the inner first light guide lens 64. The second light guide lens 262 is formed in a U shape that is convex rearward in the axial direction in a cross-sectional view viewed from the radial direction. An outer circumferential portion of the second light guide lens 262 is in contact with the outer first light guide lens 63. An inner circumferential portion of the second light guide lens 262 is in contact with the inner first light guide lens 64. The second light guide lens 262 is inserted between a reflector 7 and a half mirror 4.

The second light guide lens 262 includes the pattern forming portion 269 in which fine irregularities (fine cuts) are formed. The pattern forming portion 269 is formed in a portion of the second light guide lens 262 located between the reflector 7 and the half mirror 4. The pattern forming portion 269 is, for example, a notch formed in a circular shape or the like. As shown in FIGS. 8 and 9, in the second embodiment, a pattern displayed on a light emitting surface 45 by the pattern forming portion 269 is a plurality of circular patterns having different sizes.

The reflector 7 is disposed in front of the second light guide lens 262 in the axial direction. A surface of the reflector 7 facing the rear is formed in a flat shape.

As shown in FIG. 7, after light L, which has exited from the light source 5, is reflected by the light guide reflection surfaces 63*a* and 64*a* of the first light guide lens 61, the light L mainly exits in two directions. As in the first embodiment, after first light L21 is reflected by the light guide reflection surfaces 63*a* and 64*a*, the first light L21 is light incident on the second light guide lens 262 and obliquely incident from a light guide exit surface 262*b* of the second light guide lens 262 to the reflector 7. The first light L21 is repeatedly reflected between the reflector 7 and the half mirror 4 to form a plurality of optical paths. Thereby, light emission with a sense of depth is visually recognized. Second light L22 is light that is reflected by the light guide reflection surfaces 63*a* and 64*a* and then guided within the second light guide lens 262 in the radial direction. The second light L22 is reflected toward the light emitting surface 45 side through the notch of the pattern forming portion 269 provided in the second light guide lens 262 while the second light L22 is being guided within the second light guide lens 262 and a desired pattern is displayed on the light emitting surface 45 (see FIGS. 8 and 9).

Consequently, light emission having both a sense of depth and a sense of floating due to the pattern formed by the pattern forming portion 269 can be visually recognized.

According to the second embodiment, the light guide body 6 includes the pattern forming portion 269 having a fine cut. Thereby, when the light L22 is transmitted through the light guide body 6, a pattern giving a sense of floating can be displayed on the light emitting surface 45 according to a shape of the fine cut. It is possible to provide the lamp body 1 in which the sense of depth is further emphasized by combining the sense of floating of the pattern formed by the pattern forming portion 269 and the sense of depth by reflecting the light L (L21) between the reflector 7 and the half mirror 4.

The pattern forming portion 269 is provided on the second light guide lens 262, and the second light guide lens 262 is inserted between the reflector 7 and the half mirror 4. Thereby, the sense of floating due to the pattern formed by the pattern forming portion 269 and the depth expression given by reflecting the light L21 between the reflector 7 and the half mirror 4 can be effectively combined. Since a pattern having the sense of floating can be displayed within a space expressing the depth, the sense of floating of the pattern on the light emitting surface 45 can be emphasized. Consequently, the sense of depth and the sense of floating can be effectively expressed.

(Reference Form)

Next, a reference form according to the present invention will be described.

Figure 10:
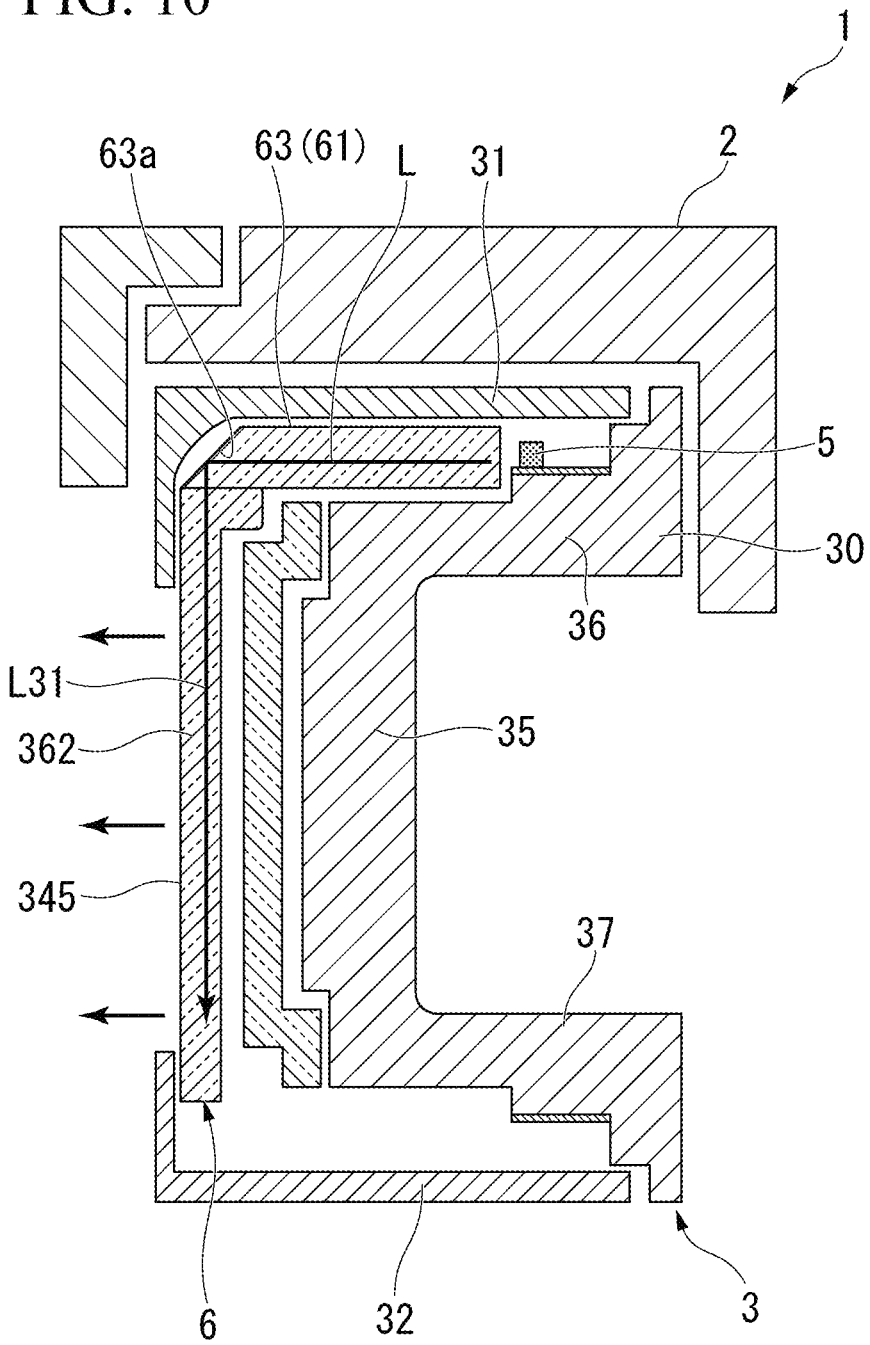
FIG. 10 is a cross-sectional view of a lamp body according to a reference form.
Figure 11:
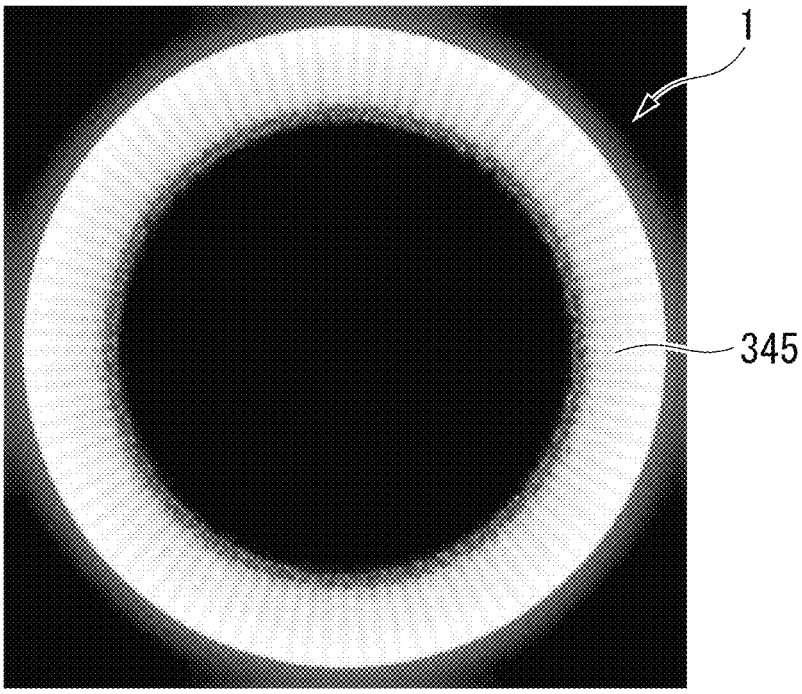
FIG. 11 is a front view showing a state of light emission of the lamp body according to the reference form.
Figure 12:
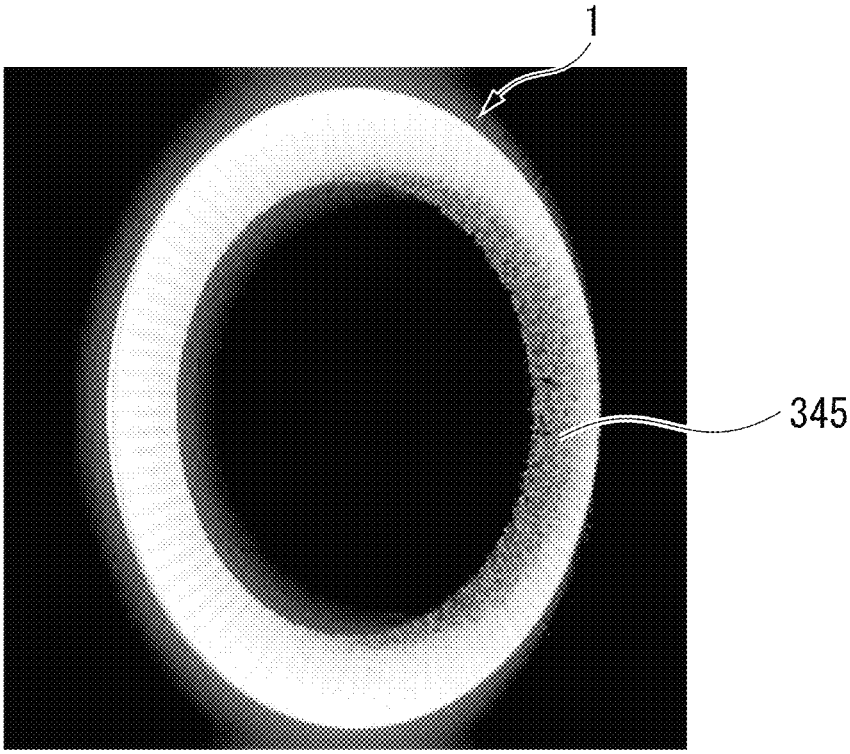
FIG. 12 is a perspective view showing a state of light emission of the lamp body according to the reference form.

FIG. 10 is a cross-sectional view of the lamp body 1 according to the reference form. FIG. 11 is a front view showing a state of light emission of the lamp body 1 according to the reference form. FIG. 12 is a perspective view of the state of light emission of the lamp body 1 according to the reference form viewed obliquely from the rear. In the following description, components similar to those in the first embodiment described above are denoted by the same reference signs and description thereof will be appropriately omitted. Reference signs which are not shown in FIGS. 10 to 12 can be appropriately referred to from FIGS. 1 to 6.

The reference form is different from the first and second embodiments in that no half mirror 4 is provided.

In the reference form, a light source 5 is provided on an outer side wall 36 of a main base 30. A first light guide lens 61 is provided between the outer side wall 36 of the main base 30 and an outer sub-base 31. A second light guide lens 362 is disposed in contact with the first light guide lens 61 and extends to a position corresponding to an inner side wall 37 of the main base 30 in a radial direction. In the reference form, a surface of the second light guide lens 362 facing rearward in the axial direction serves as a light emitting surface 345. The second light guide lens 362 has a fine cut. The fine cut is formed so that a cutting depth changes from an inner side to an outer side in the radial direction. The fine cut is formed so that the brightness on the outer side in the radial direction becomes higher than that on the inner side in the radial direction when the light L guided by the second light guide lens 362 diverges by the fine cut and is emitted from the light emitting surface 345 (see FIG. 11). A reflector 7 is provided between the second light guide lens 362 and a bottom wall 35 of the main base 30. The reflector 7 is disposed to face the second light guide lens 362.

As shown in FIG. 10, after the light L, which has exited from the light source 5, is reflected by a light guide reflection surface 63*a* of the first light guide lens 61, the light L is guided into the second light guide lens 362 in the radial direction. Light L31 guided into the second light guide lens 362 is reflected toward the light emitting surface 345 side by the fine cut provided in the second light guide lens 362. Thereby, the light is emitted from the light emitting surface 345 so that the brightness increases from the inner side in the radial direction to the outer side in the radial direction. Consequently, light emission with a sense of depth is visually recognized.

According to the reference form, as shown in FIGS. 11 and 12, a sense of depth can be expressed without using the half mirror 4, so that the number of components can be reduced. However, the above-described first and second embodiments are superior in that it is possible to suitably express a sense of depth by causing the light L to be reflected a plurality of times between the half mirror 4 and the reflector 7.

Also, the technical scope of the present invention is not limited to the above-described embodiments and various changes can be made without departing from the spirit of the present invention.

For example, although the configuration in which the light sources 5 are provided on both the outer side wall 36 and the inner side wall 37 of the main base 30 has been described in the first embodiment and the second embodiment, the present invention is not limited thereto. For example, the light source 5 may be provided only on the outer side wall 36. In this case, the inner first light guide lens 64 may be omitted.

The configuration of the reflector 7 of the first embodiment may be combined with the configuration of the second embodiment. That is, in the second embodiment, the reflector 7 may have a convex curved surface 71 that is convex toward the half mirror 4 side. In this case, it is possible to express a sense of depth of a pattern formed by the pattern forming portion 269 in addition to continuous depth expression according to a shape of the convex curved surface 71.

A pattern displayed on the light emitting surface 45 by the pattern forming portion 269 may be a shape other than a circular shape such as a polygonal shape, a straight-line shape, or a curved shape.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1 Lamp body
4 Half mirror
5 Light source
6 Light guide body
7 Reflector
40 Transparent plate
41 Plating
45, 345 Light emitting surface
61 First light guide lens
62, 262, 362 Second light guide lens
65*b*, 66*b* Light guide exit surface
71 Convex curved surface
269 Pattern forming portion
A1 Reflection area
A2 Transmission area
L, L1 to L6, L21, L22, L31 Light

What is claimed is:

1. A lamp body comprising:
a light source;
a light guide body configured to cause light from the light source to be guided and cause the light to be emitted from a light emitting surface;
a reflector configured to cause the light, which has exited from a light guide exit surface of the light guide body, to be reflected toward a side of the light emitting surface; and
a half mirror disposed to face the reflector and having a reflection area where the light reflected by the reflector is reflected toward a side of the reflector and a transmission area where the reflected light is transmitted,
wherein the light guide body includes
a first light guide lens configured to cause the light from the light source to be guided in a first direction; and
a second light guide lens having the light guide exit surface from which the light exits in a second direction intersecting the first direction and
wherein the first light guide lens and the second light guide lens are disposed in contact with each other.

2. The lamp body according to claim 1, wherein at least part of the light guide body is provided between the reflector and the half mirror.

3. The lamp body according to claim 1, wherein the light guide body includes a pattern forming portion having a fine cut.

4. The lamp body according to claim 2, wherein the light guide body includes a pattern forming portion having a fine cut.

5. The lamp body according to claim 3,
wherein the pattern forming portion is provided on the second light guide lens and
wherein the second light guide lens is inserted between the reflector and the half mirror.

6. The lamp body according to claim 4,
wherein the pattern forming portion is provided on the second light guide lens and
wherein the second light guide lens is inserted between the reflector and the half mirror.

7. The lamp body according to claim 1, wherein a distance between the reflector and the half mirror gradually changes in the second direction.

8. The lamp body according to claim 7, wherein the reflector has a convex curved surface that is convex toward a side of the half mirror.

9. The lamp body according to claim 1, wherein the half mirror is formed by disposing the reflection area formed by plating deposited on a transparent plate and the transmission area from which the plating has been removed in a grid pattern.

* * * * *